US011795790B2

(12) United States Patent
Lowe et al.

(10) Patent No.: US 11,795,790 B2
(45) Date of Patent: Oct. 24, 2023

(54) SLIDE-IN FRAME FOR SHAPED CHARGES

(71) Applicant: Schlumberger Technology Corporation, Sugar Land, TX (US)

(72) Inventors: Erick Lowe, Clamart (FR); Alexander Lee, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1 day.

(21) Appl. No.: 17/659,229

(22) Filed: Apr. 14, 2022

(65) Prior Publication Data

US 2022/0333906 A1 Oct. 20, 2022

Related U.S. Application Data

(60) Provisional application No. 63/175,120, filed on Apr. 15, 2021.

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC .... E21B 43/117; E21B 43/119; E21B 43/118; F42B 1/02; F42B 1/028; F42B 1/036
See application file for complete search history.

(56) References Cited

U.S. PATENT DOCUMENTS

| | | | | |
|---|---|---|---|---|
| 5,027,708 | A * | 7/1991 | Gonzalez | E21B 43/1185 102/202.1 |
| 10,458,213 | B1 * | 10/2019 | Eitschberger | E21B 43/117 |
| 2008/0149338 | A1 * | 6/2008 | Goodman | E21B 43/117 166/299 |
| 2017/0052011 | A1 * | 2/2017 | Parks | E21B 43/11855 |
| 2017/0199015 | A1 * | 7/2017 | Collins | F42B 33/0207 |
| 2020/0284126 | A1 * | 9/2020 | Mauldin | E21B 43/117 |
| 2022/0333906 | A1 * | 10/2022 | Lowe | E21B 43/117 |

FOREIGN PATENT DOCUMENTS

| | | | | |
|---|---|---|---|---|
| DE | 3813933 | C1 * | 10/1989 | |
| WO | WO-2012135101 | A2 * | 10/2012 | E21B 43/1185 |
| WO | WO-2014179689 | A1 * | 11/2014 | E21B 43/117 |
| WO | WO-2017029240 | A1 * | 2/2017 | E21B 43/117 |
| WO | WO-2018125180 | A1 * | 7/2018 | E21B 43/117 |
| WO | WO-2021122797 | A1 * | 6/2021 | E21B 43/117 |
| WO | WO-2022104220 | A1 * | 5/2022 | |
| WO | WO-2022104221 | A1 * | 5/2022 | |
| WO | WO-2022148557 | A1 * | 7/2022 | |
| WO | WO-2022184654 | A1 * | 9/2022 | |

* cited by examiner

*Primary Examiner* — Daniel P Stephenson
(74) *Attorney, Agent, or Firm* — Jeffrey D. Frantz

(57) ABSTRACT

A frame for a shaped charge has a body with a cylindrical configuration, the body having a central passage along an axis thereof and a track extending in a direction parallel to the axis for installing and removing a shaped charge, the track having a snap structure. The frame provides a slide-in snap-in charge receptacle for a shaped charge.

20 Claims, 5 Drawing Sheets

SLIDE-IN FRAME FOR SHAPED CHARGES

CROSS-REFERENCE TO RELATED APPLICATIONS

This application for patent claims benefit of U.S. Provisional Patent Application Ser. No. 63/175,120 filed Apr. 15, 2021, which is entirely incorporated herein by reference.

FIELD

Perforation tools and components used in hydrocarbon production are described herein. Specifically, frames for shaped charges and perforation tools employing such frames are described herein.

BACKGROUND

Perforation tools are tools used in oil and gas production to form holes, passages, and/or fractures in hydrocarbon-bearing geologic formations to promote flow of hydrocarbons from the formation into the well for production. The tools generally have explosive charges shaped to project a jet of reaction products, including hot gases and molten metal, into the formation. Typically, the tool has a generally tubular profile, and includes support frames, ignition circuits, and potentially wiring for activating the charges and communicating signals and/or data along the tool. The charges are generally shaped like a cone or a bell, and the charges are generally activated by delivering energy, such as thermochemical energy and/or electrical energy, to an apex region of the charge.

The shaped charges conventionally used have a casing to hold explosive material, the explosive material pressed into the casing, and a liner pressed onto the explosive material to retain the explosive material and protect the explosive material from the environment. The shaped charges are installed into a frame that has retention features to secure the shaped charge within the frame. Installing and removing shaped charges from frames lengthens assembly time for perforation tools and increases cost and complexity of shaped charge frames. Improved shaped charge perforation tools are needed.

SUMMARY

Embodiments described herein provide a shaped charge frame with an axially-oriented track for installing a shaped charge, the track having a snap structure.

Other embodiments described herein provide a perforation tool, comprising a charge module with a slide-in charge frame that has a snap structure.

Other embodiments described herein provide a frame for a shaped charge, the frame comprising a body with a cylindrical configuration, the body having a central passage along an axis thereof and a track, formed in a side of the body and extending in a direction parallel to the axis, for installing and removing a shaped charge, the track having a snap structure.

Other embodiments described herein provide a frame for a shaped charge, the frame comprising a body with a cylindrical configuration, the body having a central passage along an axis thereof; a recess formed in the side of the body to receive a weight body; and a track, formed in a side of the body and extending in a direction parallel to the axis, for installing and removing a shaped charge, the track having a snap structure.

DETAILED DESCRIPTION

Figure 1:
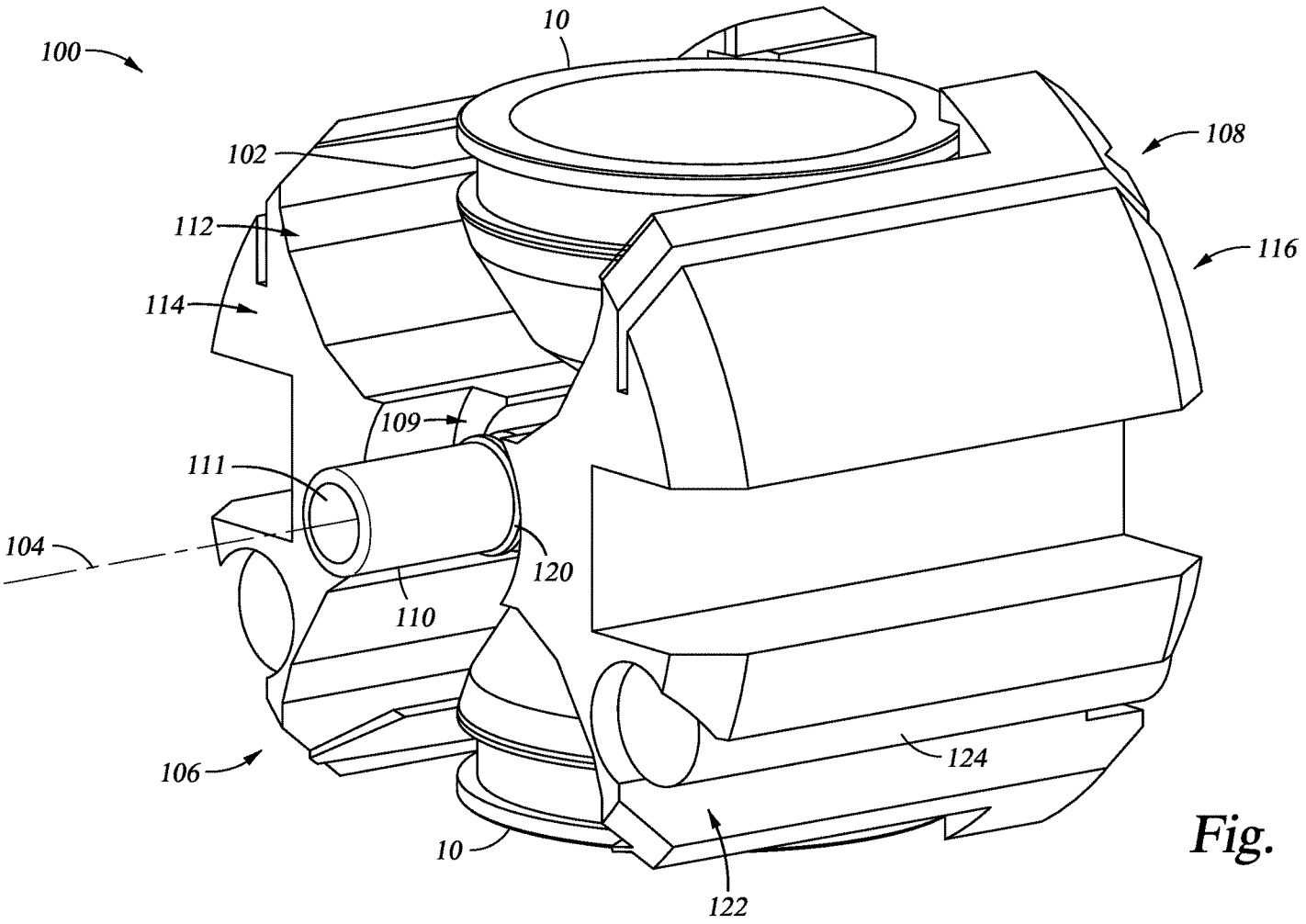
FIG. 1 is a perspective view of a charge frame according to one embodiment.

The perforation tools described herein use charge frames with axially-oriented tracks for installing and removing shaped charges. The tracks have a snap structure to secure the shaped charge to the frame. FIG. 1 is a perspective view of a charge frame 100 according to one embodiment. A charge casing 10 is shown in the frame 100 in the position of an installed shaped charge. The charge frame 100 has a body 102 with a generally cylindrical configuration. The body 102 has an axis 104, which is the axis of a cylinder with radius equal to a maximum outer radius of the body 102. The body has a first end 106 and a second end 108, opposite from the first end 106 along the axis 104. The body 102 has a central passage 109, generally cylindrical in profile and generally coaxial with the body 102, disposed along the axis 104. An electrical conductor 110 is disposed in the central passage 109 and extends from the first end 106 to the second end 108, protruding outward from both ends slightly to provide electrical connectivity with another module such as an initiation module or bulkhead module. The electrical conductor 110 has a male end 111, visible here, and a female end, which is not visible in FIG. 1. In this case, the body 102 is configured for the electrical conductor 110 to be inserted into the central passage 109 such that the male end 111 of the electrical conductor 110 is at the first end 106 of the body 102, and protrudes from the first end 106 of the body. The female end similarly protrudes from the second end 108 of the body 102. A similar electrical conductor can be used in an adjacent module, such that the male end 111 can engage with the female end of an adjacent electrical conductor to provide electrical connectivity from module to module.

The body 102 has a track 112 formed in a side of the body 102. The track 112 is generally axially-oriented, extending in a direction substantially parallel with the axis 104. A first end 114 of the track 112 is open in the axial direction while a second end 116 of the track 112 is closed in the axial direction. The track 112 has a cross-sectional profile that extends radially outward from the central passage 109, widening monotonically from a narrow bottom of the track 112 to a wide top of the track 112. The track allows a shaped charge 10 to be attached to the charge frame 100 by sliding the charge 10 along the track 112 from the first end 114 to the second end 116.

The body 102 has two tracks 112 to accommodate two charges 10, the two tracks being located on opposite sides of the body 102 with azimuthal separation of nominally 180 degrees. The two tracks are identical, each with a first end 114 at the first end 106 of the body. It should be noted that the tracks 112 can be configured with first end 106 at the second end 108 of the body. The tracks 112 can also have opposite configurations, with one track 112 having first end 114 at the first end 106 of the body 102 and the other track 112 having first end 114 at the second end 108 of the body 102.

The charge frame 100 has self-orienting features. The electrical conductor 110 is supported by a band bearing 120 that surrounds the electrical conductor 110 and is disposed between the electrical conductor 110 and an inner wall of the central passage 109. The body 102 can thus rotate around the electrical conductor 110, while the electrical conductor 110 remains connected with electrical conductors of other modules. The band bearing 120 may be fixed within the central passage 109, fixed to the electrical conductor 110, or may move freely with respect to the electrical conductor 110 and the central passage 109, with any appropriate retention features to keep the band bearing 120 in place within the central passage 109.

The body 102 has at least one recess 122 that receives a weight body 124 to provide a mass moment that orients the body 102 in the presence of a gravitational field. The recess 122 is formed in the side of the body 102, such that the weight body 124 can be inserted into the recess 122. In this case, the recess 122 extends from the first end 106 of the body and has an opening at the first end 106 to allow the weight body 124 to be inserted in and removed from the recess 122. Here, the recess 122 has a cylindrical shape with an axis generally parallel to the axis 104. Also, in this case, the recess 122 extends from the first end 106 to the second end 108 of the body 102, such that the weight body 124 can be inserted in and removed from the recess 122 at either end. The weight body 124, in this case, is a solid cylindrical body of homogeneous composition and sufficient density to provide a mass moment to orient the body 102 in the presence of a gravitational field. The shape, dimensions, and composition of the weight body 124 can be varied to provide any orientation function. Here, two recesses 122 are provided on opposite sides of the body 122, as defined by the location of the charges 10, and are azimuthally displaced such that a line between the central axes of the two recesses 122, in a plane perpendicular to both axes, is not a diameter of the body 102. In this way, a centroid of the body 102 is displaced away from the axis 104.

Figure 2:
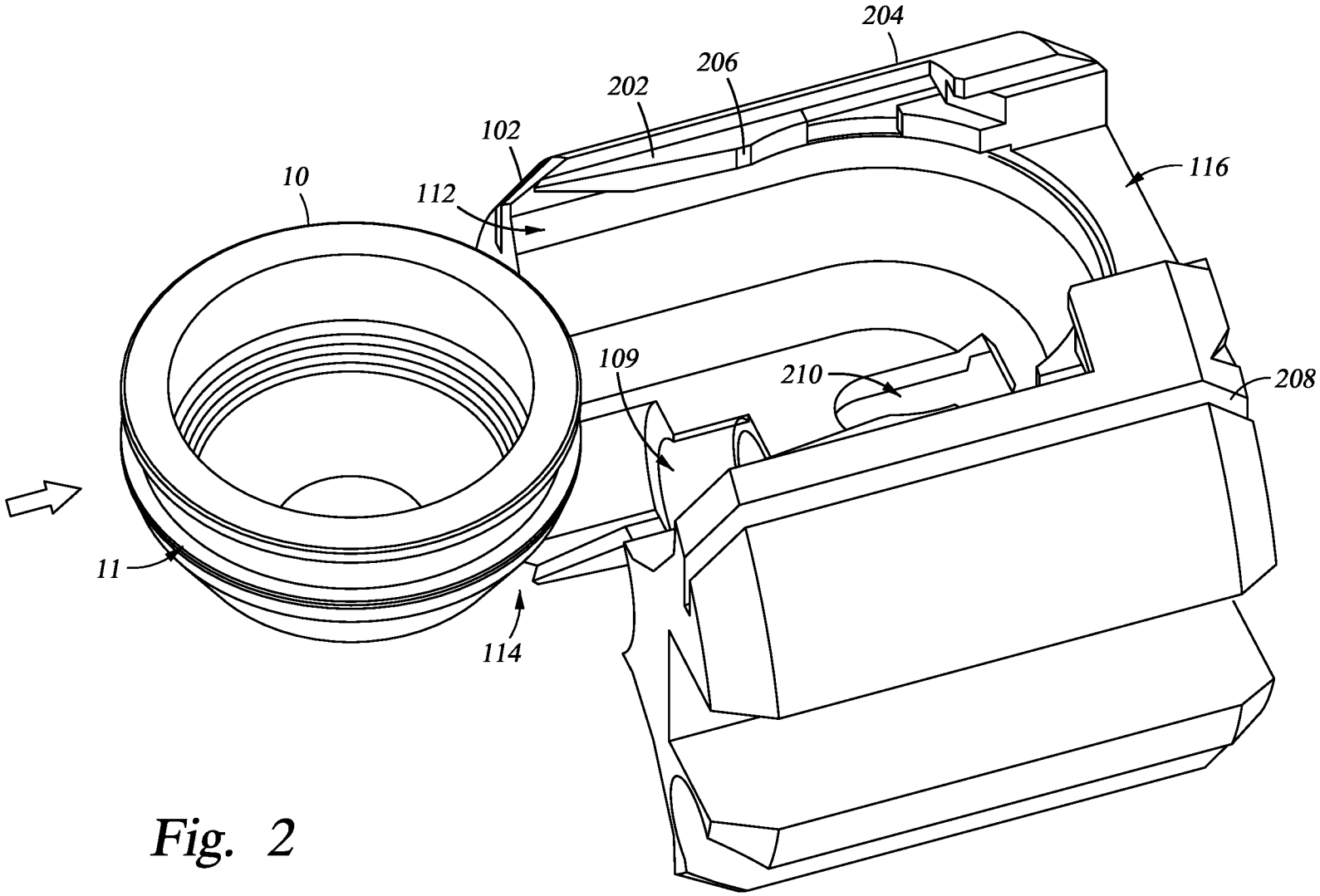
FIG. 2 is a perspective view of the charge frame of FIG. 1 showing installation of a charge.

The charge frame 100 has a snap structure that secures charges in the tracks 112. FIG. 2 is a perspective view of the charge frame 100 showing installation of a charge 10. The track 112 has two snap protrusions 202 located near a rim 204 of the track 112 on opposite sides of the track 112, one on each side of the track 112. The snap protrusions 202 start near the first end 114 of the track 112 and proceed to a snap point 206 partway along the rim 204 of the track 112.

The protrusions 202 are ledges that project inward from an inner wall of the track 112 in a direction across the valley of the track 112. The track 112 has a channel shape that follows the external shape of a charge casing. The channel shape of the track 112 is substantially symmetrical, with a plane of symmetry passing through the narrow bottom of the track and substantially intersecting with the axis 104. The protrusions 202 extend inward from the internal wall of the track 112 in a direction substantially perpendicular to the plane of symmetry of the track 112.

The snap protrusions 202 are substantially identical and mirror images, one of the other (only one snap protrusion 202 is fully visible in FIG. 2). The snap protrusions 202 extend inward from the internal wall of the track 112 a distance that increases from the first end 114 of the track 112 to the snap point 206. The typical charge casing, illustrated by the charge casing 10, has a cup or bowl shape with a circular profile and cross-sectional shape with a narrow end and a wide end, the width of the cross-sectional shape increasing monotonically from the narrow end to the wide end thereof. Adjacent to the wide end, the charge casing typically has a circumferential groove 11 formed in the external wall of the casing 10. The snap protrusions 202 engage with the groove 11 of a charge casing to provide a slide-in snap-in function to retain charges in the frame 100. The track 112 thus functions as a slide-in receptacle for a shaped charge. The groove 11 of the casing 10 engages with the snap protrusions 202 as the charge is positioned at the first end 114 of the track and moved in the axial direction along the track 112 toward the second end 116 thereof, as shown by the arrow in FIG. 2. At the groove, the charge casing has an external diameter. At the snap point 206, a distance between the snap protrusions 202 is less than the external diameter of the charge casing at the groove. The distance the protrusions 202 extend inward from the inner wall of the track 112 increases from the first end 114 of the track 112 in a linear fashion in this case, but the distance could increase according to any plan. The distance is at maximum at the snap point 206, so the gap between the protrusions 202, at the snap point 206, is at a minimum. The material of the frame 100 has a malleability, and the walls of the track 112 are shaped and/or configured, so the walls can flex outward, away from each other, when the casing 10 is pushed to the snap point 206. As the charge casing 10 is pushed beyond the snap point 206, the walls of the track 112 return to their relaxed positions, and the protrusions 202 rebound toward each other capturing the charge casing 10, so that the protrusions 202 provide restraining force on the charge 10 toward the second end 116 of the track 112. The protrusions 202 may extend a short length beyond the snap point 206, as shown here.

Some force is applied to push the charge along the track 112 past the snap point 206. The force needed to install the charge in the frame 100 can be selected by providing resiliency features associated with the snap structure. Here, grooves are formed in the body 102 to provide flexibility of the track 112 at the snap point 206. A flex groove 208 is formed in the body 102, one on either side of the track 112 (only one groove 208 is visible in FIG. 2; both are visible in FIG. 3). Each groove 208 extends along the respective side of the track 112 in the axial direction. In this case, the grooves 208 extend straight into the body 102 along the side of the track 112, with each groove 208 being parallel, in its downward extension, to the plane of symmetry of the track 112, or to an axis of the track 112. In other cases, the grooves can be angled toward the track 112, or may be curved to follow the outer contour of the track 112. In other embodiments, a resiliency feature may be a resilient member attached to (i.e. adhered to by welding or using adhesive), embedded in (i.e. disposed in a groove formed in an inward facing surface of the protrusions 202), or formed integrally with, one or both protrusions 202, along the entire length of the protrusions 202 or adjacent to, and at, the snap point 206 of one or both protrusions 202.

An opening 210 is provided at the bottom of the track 112, adjacent to the second end 116 thereof, in the charge seating area of the track 112, for fluid continuity from the central passage 109 to the shaped charge. A ballistic discharge device, such as a booster or detonation cord, is disposed in the central passage 109 to transmit a ballistic discharge to the shaped charges in the frame 100. The electrical conductor 110 (not shown in FIG. 2) also has an opening, aligned with the opening 210, such that a continuous fluid path exists from the interior of the central passage 109 to the interior of the track 112 for transmission of ballistic discharge.

Figure 3:
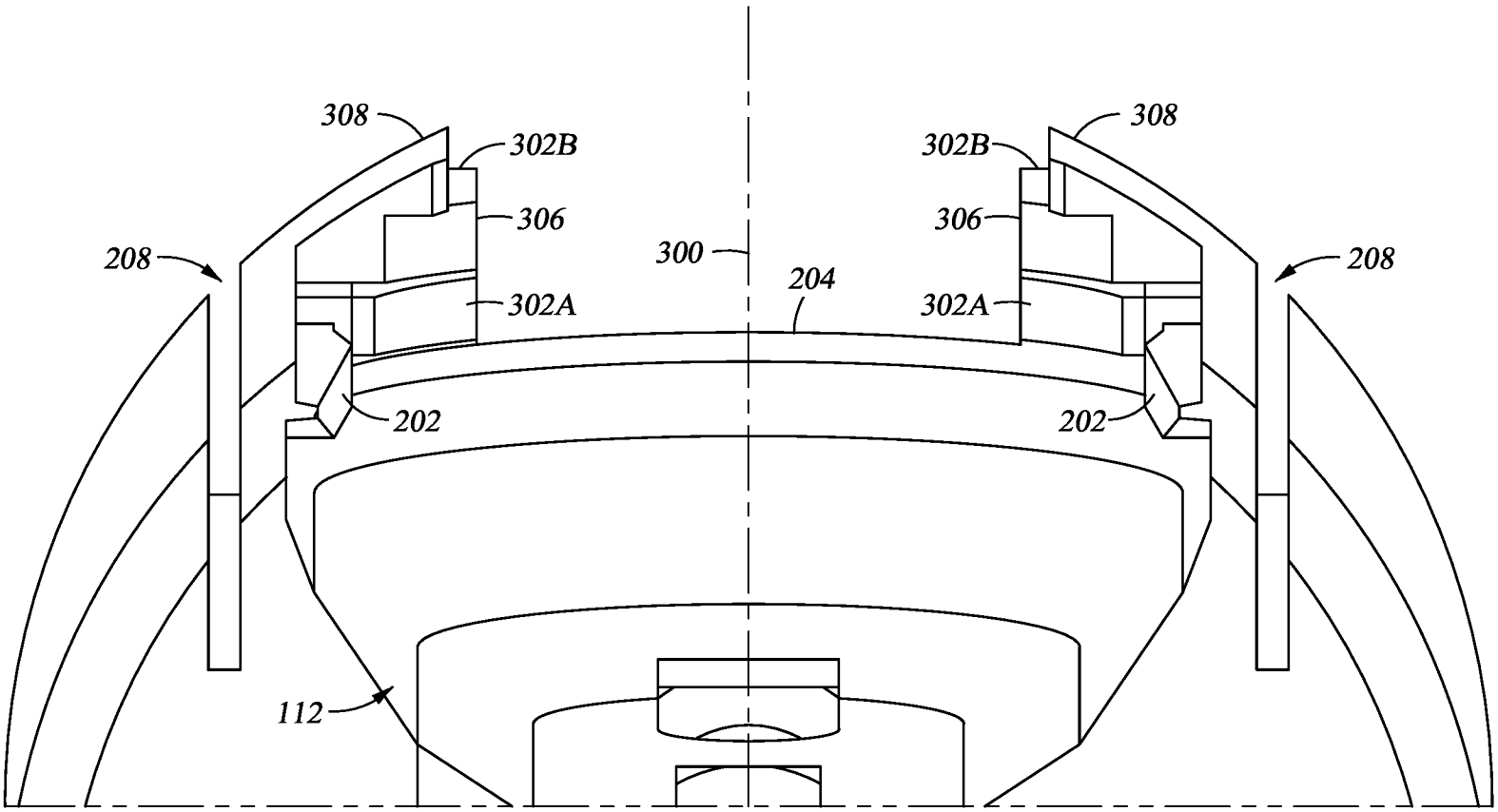
FIG. 3 is a partial end view of the charge frame of FIG. 1.

The charge is pushed past the snap point 206, and is then securely held in the frame 100. FIG. 3 is a partial end view of the charge frame of FIG. 1. This view looks down the track 112, from the first end 114 toward the second end 116 thereof. The plane of symmetry, or axis, of the track 112 referred to above is shown here as element 300, viewed edge-on. Both flex grooves 208 are shown in FIG. 3. The snap structure of the frame 100 includes at least one placement protrusion 302. Here, there are four placement protrusions 302, two lower placement protrusions 302A, one on each side of the plane of symmetry 300, and two upper placement protrusions 302B one on each side of the plane of symmetry 300.

The two lower placement protrusions 302A are protrusions similar in construction to the snap protrusions 202 extending from the inner wall of the track 112 and located adjacent to the second end 116 thereof, past the snap point 206. The two lower placement protrusions 302A engage with the groove 11 (FIG. 2) of the charge casing, similar to the snap protrusions 202. Each of the two upper placement protrusions 302B has a pedestal portion 306 disposed on the top of the rim 204 of the track 112 and an extension 308 disposed on top of the pedestal portion 306. The extension 308 of each upper placement protrusion 302B extends inward toward the interior of the track 112. Each pedestal portion 306 has a length selected to provide retaining engagement between the extensions 308 and the rim of the casing 10. When a charge is installed in the frame 100, the extensions 308 extend over the rim of the charge casing, and may contact the rim of the charge casing, while the lower placement protrusions 302A engage with, and extend into, the groove 11 (FIG. 2) of the charge casing. By collective function of the snap protrusions 202, the lower placement protrusions 302A, and the upper placement protrusions 302B, the shaped charge is held securely in the frame 100. After the shaped charge is spent, the empty charge casing can be removed by sliding along the track 112, from the second end 116 to the first end 114, past the snap point 206 to extract the casing from the frame 100.

As mentioned above, the protrusions 202 may extend a short length toward the second end 116 of the track 112 beyond the snap point 206. Alternatively, the protrusions 202 could end at the snap point 206, or the protrusions 202 could extend to the second end of the track 112 and join with the lower placement protrusions 302A.

Figure 4:
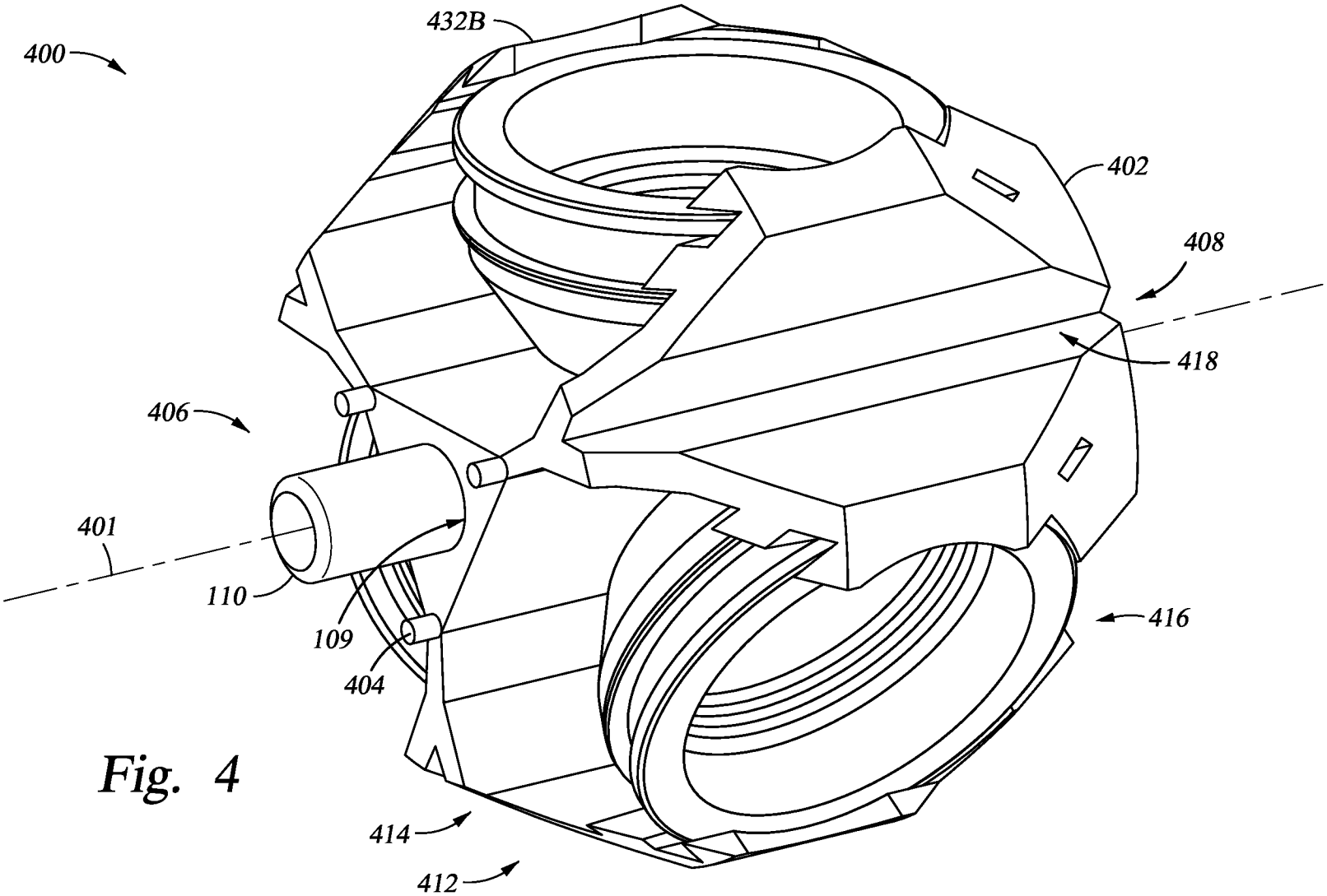
FIG. 4 is a perspective view of a charge frame according to another embodiment.

FIG. 4 is a perspective view of a charge frame 400 according to another embodiment. Charge casings are shown here again to illustrate installation of shaped charges in the frame 400. This charge frame is similar in many respects to the charge frame 100 of FIGS. 1-3. In particular, the charge frame 400 has a body with a cylindrical configuration, the body having a central passage along an axis 401 thereof and a track extending in a direction parallel to the axis for installing and removing a shaped charge, the track having a snap structure. The charge frame 400 is usable as a charge module for a perforation tool, the charge module having a slide-in charge receptacle that has a snap structure.

The charge frame 400 has a body 402 with a generally cylindrical configuration, and a plurality of tracks 412 for installing shaped charges and removing spent charge casings. In this case there are three such tracks 412, distributed around the circumference of the body 402. The body 402 has the central passage 109 and electrical conductor 110, but is not self-orienting, so the band bearing in not present in this embodiment. The body 402 therefore has orienting features 404 at a first end 406 thereof, and may also have orienting features (not shown) at a second end 408 thereof, opposite from the first end 406. The orienting features 404, in this case, are small projections formed in a hub area of the body 402 at the first end 406. The small projections can engage with recesses in another module to orient the frame 400 with respect to the other module.

Each track 412 has a first end 414 and a second end 416, similar to the tracks 112. In this case, the body 402 is beveled at the ends 406 and 408, so the first and second ends 414 and 416 of the tracks 412 are beveled. Because the ends 414 and 416 are beveled, the body 402 has upper placement protrusions 432B that are located near a mid-point of the body 402, as measured along the axis 401. A cutout 418 is formed in the outer surface of the body 402 between each pair of neighboring tracks 412 as resiliency features. The cutouts 418 allow the walls of the tracks 412 to flex as the charge is inserted and removed. Here, the cutouts are v-shaped and extend from the first end 406 to the second end 408 of the body 402.

The bevels of the ends of the body 402 and the cutouts 418 give the walls of the tracks 412 the shape of wings with a broad base, near a hub 420 of the body 402, that has a width equal to the length of the body 402 at the hub 420. Since there are three tracks 412, the hub 420 has a shape generally similar to an equilateral triangular prism. The walls of the tracks 412 extend away from the hub 420, narrowing in width, to the upper placement protrusions 432B, which are located a substantially equal distance from the first and second ends 406 and 408 of the body 402.

Figure 5:
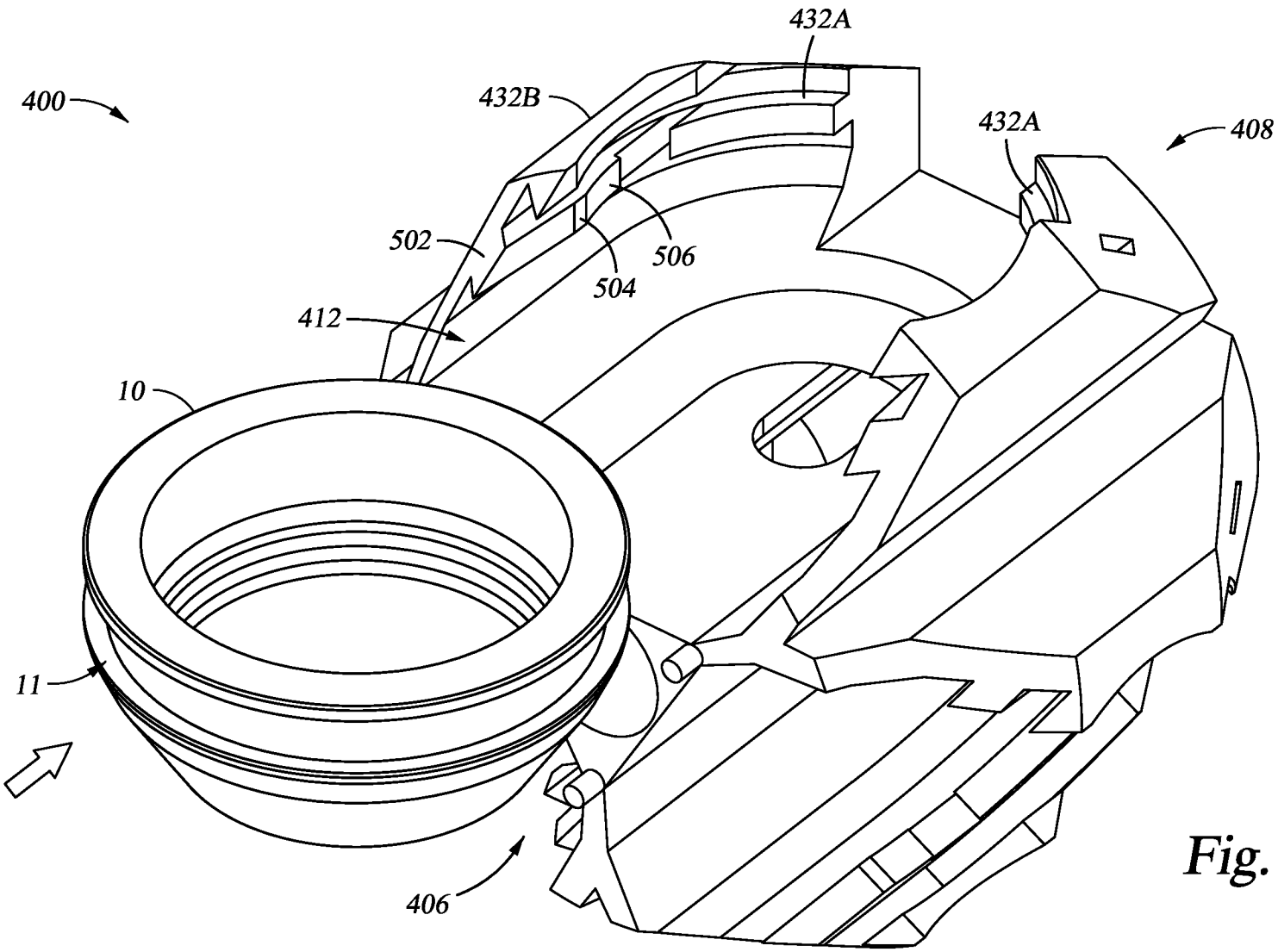
FIG. 5 is a perspective view of the charge frame of FIG. 4 showing installation of a charge.

FIG. 5 is a perspective view of the charge frame 400 of FIG. 4 showing installation of a charge. The charge is inserted in a similar manner to the frame 100. The charge slides along the track 412, as shown by the arrow in FIG. 5. The frame 400 has snap protrusions 502 that are similar to the snap protrusions 202 of FIG. 2. The snap protrusions 502 start at the beveled edge of the track 412 that is closest to the first end 406 and proceed along the wall of the track 412 toward the second end 408 to a snap point 504. Here, a distance between the snap protrusion 502 and the top of the track wall varies because the beveled edge of the track continues upward from the end of the snap protrusion 502. The upper placement protrusions 432B are aligned with the snap protrusions 502 in this case. The upper placement protrusions 432B are located at a point substantially equidistant from the first end 406 and the second end 408 of the body 402. A lower placement protrusion 432A is located near the second end 408 of the body 402 for engaging with the groove 11 of the charge casing. The snap protrusions 502 also have a central zone 506, between the snap point 504 and the second end 408 of the body, that engages with the groove 11 after the charge is pressed past the snap point 504.

While the foregoing is directed to embodiments of the present invention, other and further embodiments of the present disclosure may be devised without departing from the basic scope thereof, and the scope thereof is determined by the claims that follow.

We claim:

1. A frame for a shaped charge, the frame comprising:

a body with a cylindrical configuration, the body having a central passage along an axis thereof and a track, formed in a side of the body and extending in a direction parallel to the axis, for installing and removing a shaped charge, the track having:

a first end and a second end opposite from the first end in a direction parallel to the axis, the first end being open and the second end being closed; and a snap structure comprising a protrusion formed along an interior wall of the track, wherein the protrusion extends inward from the interior wall of the track a distance that increases from the first end of the track to a maximum distance at a snap point.

2. The frame of claim 1, further comprising a self-orienting feature.

3. The frame of claim 1, wherein a flex groove is formed in the body to allow walls of the track to flex.

4. The frame of claim 3, wherein the flex groove is parallel to a central axis of the track.

5. The frame of claim 4, further comprising a plurality of placement protrusions located at the second end of the track.

6. A perforation tool, comprising:

a charge module with a slide-in charge frame that has a snap structure, the slide-in charge frame comprising:

a body with a cylindrical configuration, the body comprising:

a central passage along an axis of the body; and a track, formed in a side of the body and extending in a direction parallel to the axis, for installing and removing a shaped charge, the track having the snap structure; and an electrical conductor disposed within the central passage.

7. The perforation tool of claim 6, wherein the slide-in charge frame further comprises a self-orientation feature.

8. The perforation tool of claim 7, wherein the snap structure comprises a protrusion formed along an interior wall of the track.

9. The perforation tool of claim 8, wherein the protrusion forms a snap point along the track.

10. The perforation tool of claim 9, wherein the protrusion extends a varying distance inward from the interior wall of the track.

11. The perforation tool of claim 10, wherein the track has a first end and a second end opposite from the first end in a direction parallel to the axis, the first end being open and the second end being closed, and the protrusion extends inward from the interior wall of the track a distance that increases from the first end of the track to a maximum distance at the snap point.

12. The perforation tool of claim 8, wherein the protrusion extends a varying distance inward from the interior wall of the track.

13. The perforation tool of claim 12, wherein the track has a first end and a second end opposite from the first end in a direction parallel to the axis, the first end being open and the second end being closed, and the protrusion extends inward from the interior wall of the track a distance that increases from the first end of the track to a maximum distance at a snap point.

14. A frame for a shaped charge, the frame comprising:

a body with a cylindrical configuration, the body having:

a central passage along an axis thereof;

a recess formed in the side of the body to receive a weight body; and a track, formed in a side of the body and extending in a direction parallel to the axis, for installing and removing a shaped charge, the track having a snap structure; and an electrical conductor disposed within the central passage such that the body can rotate about the electrical conductor.

15. The frame of claim 14, wherein the snap structure comprises a protrusion that is formed along an interior wall of the track and that provides a snap point along the track.

16. The frame of claim 15, wherein the protrusion extends inward from the interior wall of the track a varying distance.

17. The frame of claim 16, wherein the track has a first end and a second end opposite from the first end in a direction parallel to the axis, the first end being open and the second end being closed, and the protrusion extends inward from the interior wall of the track a distance that increases from the first end of the track to a maximum distance at the snap point.

18. The frame of claim 17, wherein a flex groove is formed in the body to allow walls of the track to flex.

19. The frame of claim 18, wherein the flex groove is parallel to a central axis of the track.

20. The frame of claim 14, further comprising a self-orienting feature.

* * * * *